US010692305B2

(12) United States Patent
Ohno et al.

(10) Patent No.: US 10,692,305 B2
(45) Date of Patent: Jun. 23, 2020

(54) STORAGE CONDITION SETTING DEVICE AND DATA STORAGE SYSTEM FOR VEHICLE DIAGNOSIS

(71) Applicant: HONDA MOTOR CO., LTD., Tokyo (JP)

(72) Inventors: Tetsuya Ohno, Tokyo (JP); Makoto Uchida, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 190 days.

(21) Appl. No.: 15/378,620

(22) Filed: Dec. 14, 2016

(65) Prior Publication Data

US 2017/0178425 A1 Jun. 22, 2017

(30) Foreign Application Priority Data

Dec. 16, 2015 (JP) ..... 2015-245385

(51) Int. Cl.
*G07C 5/08* (2006.01)
*G07C 5/00* (2006.01)

(52) U.S. Cl.
CPC ..... *G07C 5/08* (2013.01); *G07C 5/008* (2013.01); *G07C 5/0808* (2013.01); *G07C 2205/02* (2013.01)

(58) Field of Classification Search
CPC ..... G07C 5/08; G07C 5/008; G07C 2205/02
See application file for complete search history.

(56) References Cited

U.S. PATENT DOCUMENTS

| | | | |
|---|---|---|---|
| 5,491,631 | A | 2/1996 | Shirane et al. |
| 2002/0002430 | A1 | 1/2002 | Nada |
| 2003/0050747 | A1 | 3/2003 | Kamiya |
| 2004/0172177 | A1 | 9/2004 | Nagai et al. |
| 2007/0030844 | A1 | 2/2007 | Fukuta et al. |
| 2009/0299566 | A1 | 12/2009 | Tanigawa et al. |
| 2010/0205450 | A1 | 8/2010 | Sarnacke et al. |

(Continued)

FOREIGN PATENT DOCUMENTS

| | | | |
|---|---|---|---|
| JP | 62-142849 | A | 6/1987 |
| JP | 05-171998 | A | 7/1993 |

(Continued)

OTHER PUBLICATIONS

Japanese Office Action Notification of Reasons for Refusal application No. 2014-114870 dated Aug. 22, 2017.

(Continued)

*Primary Examiner* — Khoi H Tran
*Assistant Examiner* — Rodney P King
(74) *Attorney, Agent, or Firm* — Squire Patton Boggs (US) LLP

(57) ABSTRACT

A storage condition setting device searches, from among a plurality of ECUs that reside within an in-vehicle network, for a target ECU corresponding to a diagnostic item that is input to an input unit. In the case that such a target ECU exists, the storage condition setting device acquires from the target ECU equipment information of a vehicle related to storage conditions that correspond to the diagnostic item, and selects and sets as storage condition data in the target ECU only those items that correspond to the equipment information from among the storage conditions.

8 Claims, 7 Drawing Sheets

(56) References Cited

U.S. PATENT DOCUMENTS

| | | | | |
|---|---|---|---|---|
| 2012/0197481 | A1* | 8/2012 | Takeda | B60W 50/0205 701/31.4 |
| 2013/0311526 | A1 | 11/2013 | Uesaka | |
| 2014/0371977 | A1 | 12/2014 | Sumi et al. | |

FOREIGN PATENT DOCUMENTS

| | | | | |
|---|---|---|---|---|
| JP | 09-210867 | A | | 8/1997 |
| JP | 2001-317403 | A | | 11/2001 |
| JP | 2003-114943 | A | | 4/2003 |
| JP | 2006-505792 | A | | 2/2006 |
| JP | 2006-291730 | A | | 10/2006 |
| JP | 2007-038921 | A | | 2/2007 |
| JP | 2008-070133 | A | | 3/2008 |
| JP | 2009-293951 | A | | 12/2009 |
| JP | 2010-202127 | A | | 9/2010 |
| JP | 2010202127 | A | * | 9/2010 |
| JP | 2012-168024 | A | | 9/2012 |

OTHER PUBLICATIONS

Japanese Notice of Allowance Patent Application No. 2015-245385 dated Jul. 4, 2017.
U.S. Office Action U.S. Appl. No. 14/723,671, dated May 15, 2017.

* cited by examiner

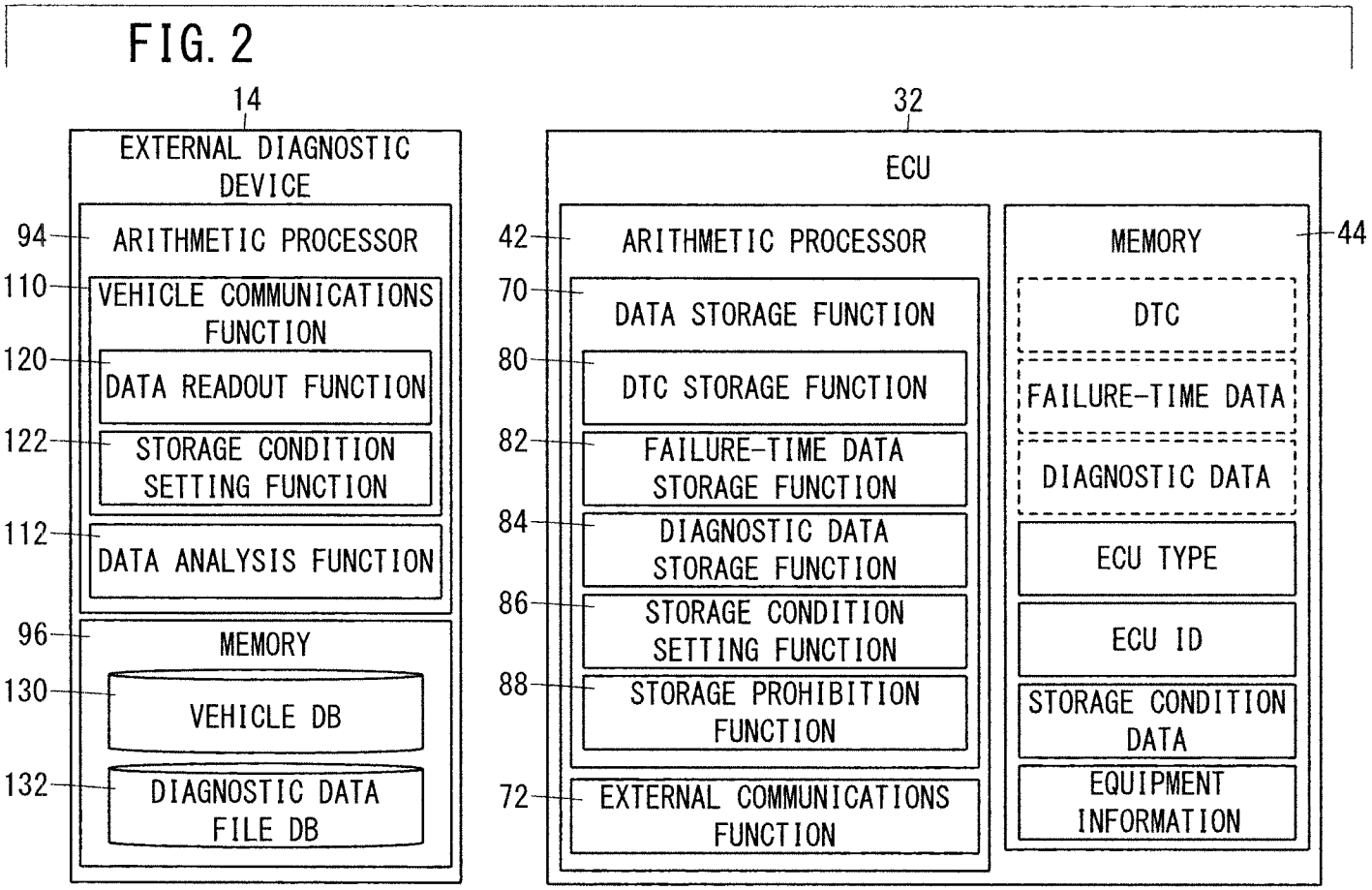
FIG. 2
14
EXTERNAL DIAGNOSTIC DEVICE
ARITHMETIC PROCESSOR
VEHICLE COMMUNICATIONS FUNCTION
DATA READOUT FUNCTION
STORAGE CONDITION SETTING FUNCTION
DATA ANALYSIS FUNCTION
MEMORY
VEHICLE DB
DIAGNOSTIC DATA FILE DB
94
110
120
122
112
96
130
132
32
ECU
ARITHMETIC PROCESSOR
DATA STORAGE FUNCTION
DTC STORAGE FUNCTION
FAILURE-TIME DATA STORAGE FUNCTION
DIAGNOSTIC DATA STORAGE FUNCTION
STORAGE CONDITION SETTING FUNCTION
STORAGE PROHIBITION FUNCTION
EXTERNAL COMMUNICATIONS FUNCTION
42
70
80
82
84
86
88
72
44
MEMORY
DTC
FAILURE-TIME DATA
DIAGNOSTIC DATA
ECU TYPE
ECU ID
STORAGE CONDITION DATA
EQUIPMENT INFORMATION

STORAGE CONDITION SETTING DEVICE AND DATA STORAGE SYSTEM FOR VEHICLE DIAGNOSIS

CROSS-REFERENCE TO RELATED APPLICATION

This application is based upon and claims the benefit of priority from Japanese Patent Application No. 2015-245385 filed on Dec. 16, 2015, the contents of which are incorporated herein by reference.

BACKGROUND OF THE INVENTION

Field of the Invention

The present invention relates to a storage condition setting device and a data storage system for vehicle diagnosis.

Description of the Related Art

In the event that an electronic control device (ECU) detects an abnormality symptom during driving of a vehicle, data and a failure code (DTC: Diagnostic Trouble Code) indicative of the abnormality symptom are stored. However, even in the case that the ECU does not store a DTC, cases occur in which the driver senses an abnormality symptom. In order to analyze cases of this type, a technique has been disclosed in which a specified type of diagnostic data is stored at a timing not accompanied by storage of a DTC (see, U.S. Patent Application Publication No. U52003/0050747, hereinafter referred to as "US2003/0050747A1").

According to US2003/0050747A1, a function modifying information transmission process is disclosed, by which function modifying information is corrected for storing the specified vehicle data at a designated timing (abstract, FIG. 9). More specifically, in US2003/0050747A1 (abstract, FIG. 9, paragraphs [0085] to [0091]), when a predetermined operation is performed with respect to an input unit of a terminal device 20, an operator in charge of vehicle repairs transmits to a center 30 the input failure information 32 (step S600), and the terminal device receives analytical information including the corresponding function modification information (step S610: YES). Furthermore, the terminal device 20 makes a request to an ECU 10 for a software product number 34 of a control program including a diagnostic program 12 (step S630), and acquires from the center 30 a data assignment table 35 (steps S640, S650). In addition, using the data assignment table 35, the terminal device 20 converts the function modifying information according to the control program (step S660), and transmits the function modifying information to the ECU 10 (step S670). In the ECU 10, the function modifying information is stored in the form of a table, and the diagnostic program 12 stores vehicle data on the basis of the function modifying information.

Within the failure information 32 transmitted to the center 30, there are contained a diagnostic code 321 read out from the ECU 10, a failure situation 322, a vehicle name 323, an engine name 324, and a production time period 325 that are input by the operator in charge of repairs (see FIG. 8 and paragraph [0086]). Further, instead of being input by the operator in charge of repairs, the vehicle name 323, the engine name 324, and the production time period 325 may be acquired from the ECU 10 (see paragraph [0086]).

SUMMARY OF THE INVENTION

As described above, according to US2003/0050747A1, the diagnostic code 321, the failure situation 322, the vehicle name 323, the engine name 324, and the production time period 325 are included within the failure information 32 that is transmitted from the terminal device 20 to the center 30 (FIG. 8, paragraph [0086]). Among these items, the diagnostic code 321 and the failure situation 322 can be acquired from the ECU 10, whereas the vehicle name 323, the engine name 324, and the production time period 325 are input in accordance with judgments made by the operator.

Further, according to US2003/0050747A1, the terminal device 20 issues a request to the ECU 10 for the software product number 34 of the control program including the diagnostic program 12 (step S630, paragraph [0089]). According to US2003/0050747A1, only a single ECU 10 is shown (see FIG. 1), and in the terminal device 20, the ECU 10 to which the request for the software product number 34 is issued is designated in advance.

However, when the function modifying information is set corresponding to operation data (a driving parameter data group) that is desired to be obtained as diagnostic data, specification of the target ECU, also including a judgment as to whether or not the ECU 10 exists as a setting target for the function modifying information, and the existence on the side of the vehicle of a corresponding driving system must be confirmed.

Further, not only specifications of the ECU 10, but it also is necessary to confirm whether or not the ECU 10 is equipped with driving parameters for setting storage conditions and obtaining operation data (i.e., whether or not it is possible with the vehicle to acquire data of the driving parameters). For example, in the case it is attempted to obtain operation data by setting storage conditions related to an idle stop control, it is necessary to confirm implementation of the idle stop control in the vehicle that is a diagnostic target, and the existence of equipment (i.e. equipped driving parameters) of the actual vehicle that corresponds to the storage conditions.

Furthermore, concerning such operations, it is necessary to selectively input, from among a driving parameter group with which the vehicle is equipped, respective storage condition data indicative of the storage conditions corresponding to symptoms such as a malfunction or the like. Concerning a case in which driving parameters cannot be acquired on the side of the vehicle, when a trigger timing for recording is set as storage condition data, it becomes impossible to record operation data because the trigger timing for such driving parameters does not exist, causing a hindrance to operations.

Consequently, when the storage condition data are set, in relation to respective driving parameter groups that form the storage condition data, it is necessary to confirm whether they can actually be acquired by the vehicle, and to select and set only those items that are capable of being acquired.

The present invention has been devised in consideration of the circumstances described above, and has the object of providing a storage condition setting device and a data storage system, which are capable of suitably setting storage conditions for diagnostic data to be stored in a vehicle.

A storage condition setting device according to the present invention serves to set storage conditions for diagnostic data, and is connected from the exterior of a vehicle with respect to a specified electronic control device (hereinafter referred to as a "target ECU"), which monitors driving conditions of the vehicle and stores operation data as diagnostic data in case of failure.

The storage condition setting device comprises an input unit for inputting a diagnostic item, and a memory for storing in association with the diagnostic item the storage conditions and identifying information of the target ECU.

Furthermore, the storage condition setting device searches, from among a plurality of electronic control devices (hereinafter referred to as "ECUs") that exist within an in-vehicle network of the vehicle, for the target ECU that corresponds to the diagnostic item input to the input unit.

Further, in the case that the target ECU exists, the storage condition setting device acquires from the target ECU equipment information of the vehicle related to the storage conditions that correspond to the diagnostic item, and selects and sets as storage condition data in the target ECU only those storage conditions that correspond to the equipment information from among all the storage conditions.

According to the present invention, specification of the target ECU that sets the storage conditions, and setting of only the storage conditions that correspond to the equipment information of the vehicle can be carried out suitably responsive to the diagnostic items input to the input unit from the exterior of the vehicle.

Further, with the present invention, the equipment information of the vehicle in relation to the storage conditions corresponding to the diagnostic items input to the input unit is obtained from the target ECU, and storage condition data corresponding to the equipment information of the target ECU are selectively set. Consequently, storage conditions are not set mistakenly in relation to driving parameters that cannot be acquired by the vehicle that serves as the diagnostic target, and it is possible to eliminate mistaken operations (trigger malfunctions) for which data storage cannot be performed.

In the above-described storage condition setting device, when searching for the target ECU, the storage condition setting device may transmit with respect to the in-vehicle network as a whole a common ECU identifying information request signal for requesting identifying information of the plurality of ECUs. In accordance with this feature, the storage condition setting device is capable of specifying the target ECU by collectively acquiring the identifying information of the plurality of ECUs.

After being connected to the in-vehicle network, the above-described storage condition setting device may first transmit with respect to the in-vehicle network as a whole a vehicle identifying information request signal for requesting vehicle identifying information. Further, the vehicle condition setting device may acquire the vehicle identifying information by receiving a reply signal from an ECU in which the vehicle identifying information is stored, together with initiating a search for the target ECU.

In accordance with this feature, confirmation of the ON state (a state in which communications are possible) of the in-vehicle network can be carried out concurrently with acquisition of the vehicle identifying information. Consequently, processing can be simplified compared to the case of acquiring the vehicle identifying information after having confirmed the ON state.

When the storage condition data is set in the target ECU, and in the case that preexisting storage condition data exists in the target ECU, the above-described storage condition setting device may issue a notification to prompt erasure of the storage condition data from the target ECU. In accordance with this feature, even in the case that operation data corresponding to different storage conditions are recorded repeatedly, diagnostic data corresponding to the preexisting storage condition data can be read out from the target ECU without forgetting.

In the above-descried storage condition setting device, the memory of the target ECU may further comprise a first area in which the storage conditions are stored, and a second area in which there are stored failure-time storage condition data, which define failure-time storage conditions for storing together with a failure code failure-time data when a failure occurs. In accordance with this feature, storage of failure-time data and failure codes, as well as storage of diagnostic data can both be managed.

The plurality of ECUs that reside within the in-vehicle network may each include a first identifier for narrowing candidates for the target ECU from among the plurality of ECUs, and a second identifier for determining whether or not the candidates for the target ECU are the target ECU.

Further, the storage condition setting device may request the first identifier with respect to the plurality of ECUs, and may narrow the candidates for the target ECU using the first identifiers received from the plurality of ECUs. Further, the storage condition setting device may request the second identifier with respect to the candidates for the target ECU, and may determine whether or not the candidates for the target ECU are the target ECU using the second identifiers received from the candidates for the target ECU.

In accordance with this feature, by making judgments in accordance with the first identifier and the second identifier, a more detailed distinction can be made.

The storage conditions for the diagnostic data may include a storage timing for storing the diagnostic data. In accordance with this feature, arbitrary diagnostic data that an operator wishes to acquire can be acquired in various situations.

A data storage system according to the present invention is equipped with a storage condition setting device for setting storage conditions for diagnostic data, and which is connected from the exterior of a vehicle with respect to an in-vehicle network, and a target ECU, in which there are stored as diagnostic data operation data when driving conditions of the vehicle are monitored and a fault occurs.

The storage condition setting device comprises an input unit for inputting a diagnostic item, and a memory for storing in association with the diagnostic item the storage conditions and identifying information of the target ECU.

Furthermore, the storage condition setting device searches, from among a plurality of ECUs that exist within the in-vehicle network, for the target ECU that corresponds to the diagnostic item input to the input unit.

In addition, in the case that the target ECU exists, the storage condition setting device acquires from the target ECU equipment information of the vehicle related to the storage conditions that correspond to the diagnostic item, and selects and sets as storage condition data in the target ECU only those storage conditions that correspond to the equipment information from among the storage conditions.

According to the present invention, specification of the target ECU that sets the storage conditions, and setting of only the storage conditions that correspond to the equipment information of the vehicle can be carried out suitably responsive to the diagnostic items input to the input unit from the exterior of the vehicle.

The above and other objects, features, and advantages of the present invention will become more apparent from the following description when taken in conjunction with the accompanying drawings, in which a preferred embodiment of the present invention is shown by way of illustrative example.

BRIEF DESCRIPTION OF THE DRAWINGS

FIG. 2 is a view showing various functions possessed by the external diagnostic machine and electronic control devices in the present embodiment;

DESCRIPTION OF THE PREFERRED EMBODIMENTS

A. Embodiment

A-1. Configuration

[A-1-1. Overall Configuration]

Figure 1:
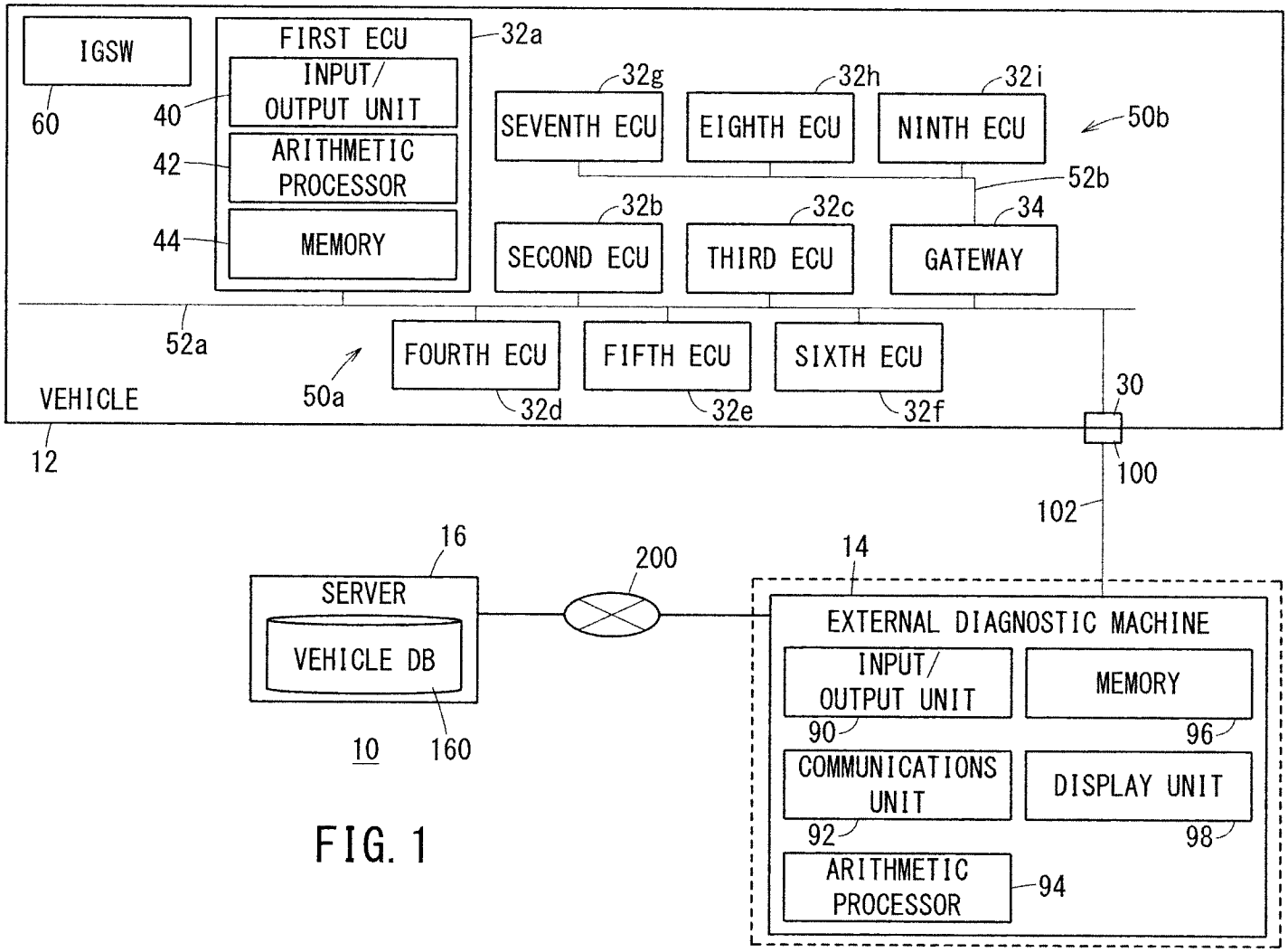
FIG. 1 is a block diagram showing an outline configuration of a diagnostic system including an external diagnostic machine constituting a storage condition setting device according to an embodiment of the present invention.

FIG. 1 is a block diagram showing an outline configuration of a diagnostic system 10 (hereinafter also referred to as a "system 10") including an external diagnostic machine 14 constituting a storage condition setting device according to an embodiment of the present invention. The system 10 includes a vehicle 12 as a diagnostic target, the external diagnostic machine 14 that performs a failure diagnosis on the vehicle 12 from the exterior of the vehicle 12, and a server 16 that supplies information of the vehicle 12 to the external diagnostic machine 14. The diagnostic system 10 functions as a diagnostic data storage system for the vehicle 12. Below, the external diagnostic machine 14 will also be referred to simply as a diagnostic machine 14.

(A-1-2. Vehicle 12)

(A-1-2-1. Overall Configuration)

The vehicle 12 according to the present invention is a four wheeled vehicle in the form of a hybrid vehicle having a driving engine and a traction motor (neither of which are shown). Alternatively, the vehicle 12 may be a gasoline vehicle having only the engine without the traction motor, an electric vehicle (battery vehicle), or a fuel cell vehicle or the like, and further, may be a two wheeled or a three wheeled vehicle.

The vehicle 12 includes a data link connector 30, a plurality of electronic control devices 32*a* to 32*i* for controlling the vehicle 12, and a gateway 34. Hereinafter, the electronic control devices 32*a* to 32*i* will be referred to as "first through ninth ECUs 32*a* to 32*i*" or "ECUs 32*a* to 32*i*", and will be referred to collectively as "ECUs 32". Moreover, in FIG. 1, in order to facilitate understanding, nine ECUs 32*a* to 32*i* are shown. However, additional ECUs apart from the ECUs 32 may also be provided. As the number of ECUs 32, for example, any number from two to several hundred ECUs can be provided.

(A-1-2-2. ECUs 32)

(A-1-2-2-1. Outline of ECUs 32)

As examples of the ECUs 32, there can be cited an engine ECU, a motor ECU, a transmission ECU, a vehicle behavior stabilizing ECU (hereinafter referred to as a "VSA ECU"), an anti-lock brake system ECU (hereinafter referred to as an "ABS ECU"), an electric power steering ECU (hereinafter referred to as an "EPS ECU"), a battery ECU, a meter ECU, an air conditioner ECU, an auxiliary restraint system ECU (hereinafter referred to as an "SRS ECU"), and an immobilizer ECU, etc.

The engine ECU controls the output of a non-illustrated engine. The motor ECU controls the output of a non-illustrated traction motor. The transmission ECU controls a non-illustrated transmission. The VSA ECU implements a vehicle behavior stabilizing (Vehicle Stability Assist) control. The ABS ECU implements an anti-lock brake control. The EPS ECU implements a steering assist control. The battery ECU controls charging and discharging of a high voltage battery or a low voltage battery. The meter ECU controls a meter display device (not shown) provided in a non-illustrated instrument panel. The air conditioner ECU controls a non-illustrated air conditioner. The SRS ECU carries out control of a non-illustrated airbag system. The immobilizer ECU carries out control of an immobilizer device and a smart key system, neither of which are shown.

The respective ECUs 32 each include an input/output unit 40, an arithmetic processor 42, and a memory 44. It is noted that, in FIG. 1, only the input/output unit 40, the arithmetic processor 42, and the memory 44 of the first ECU 32*a* are shown, whereas illustrations of the internal configurations concerning the other ECUs 32*b* to 32*i* have been omitted.

The first through sixth ECUs 32*a* to 32*f* are connected through a communications bus 52*a*, and thereby make up an in-vehicle network 50*a* (hereinafter also referred to as a "network 50*a*"). In the present embodiment, the network 50*a* is a CAN (Controller Area Network), and in particular, is a so-called high speed communications CAN (hereinafter referred to as a "high speed CAN") as defined by ISO11898.

The seventh through ninth ECUs 32*g* to 32*i* are connected through a communications bus 52*b*, and thereby make up another in-vehicle network 50*b* (hereinafter also referred to as a "network 50*b*"). In the present embodiment, the network 50*b* is a CAN, and in particular, is a so-called low speed communications CAN (hereinafter referred to as a "low speed CAN") as defined by ISO11519.

Alternatively, concerning the networks 50*a*, 50*b*, the features of the present invention can also be applied with respect to other types of networks such as a LIN (Local Interconnect Network), a FlexRay network, a K-line network or the like. Hereinafter, the networks 50*a*, 50*b* will be referred to collectively as in-vehicle networks 50 or simply networks 50.

Further, all of the ECUs 32 that are mounted in the vehicle 12 are supplied with power through an ignition switch 60 (hereinafter referred to as an "IGSW 60"). Even in the event that the IGSW 60 is turned off, some of the ECUs 32 receive power supplied from the non-illustrated low voltage battery and continue to be activated. In this case, the ECUs are set to continue operations that differ from that when the IGSW 60 is turned on.

(A-1-2-2-2. Arithmetic Processors 42 of ECUs 32)

FIG. 2 is a view showing various functions possessed by the external diagnostic machine 14 and the ECUs 32 in the present embodiment. As shown in FIG. 2, the arithmetic processor 42 of each of the ECUs 32 includes a data storage function 70 and an external communications function 72. The data storage function 70 is a function to store various types of data that the diagnostic machine 14 acquires from the vehicle 12. The external communications function 72 is a function to enable communications with the exterior of the vehicle 12 (in this case, the diagnostic machine 14) through the data link connector 30 and the in-vehicle networks 50.

The data storage function 70 includes a DTC storage function 80, a failure-time data storage function 82, a diagnostic data storage function 84, a storage condition setting function 86, and a storage prohibition function 88.

The DTC storage function 80 is a function to store failure codes, also referred to as diagnostic trouble codes (DTC). The failure-time data storage function 82 is a function to store data Do at the time of a failure occurrence (hereinafter referred to "failure-time data Do") along with storage of the DTCs. The failure occurrence time referred to above is indicative of a trigger timing (=DTC storage timing) when the occurrence of a failure determination is confirmed.

During driving, the operation data is constantly monitored and temporary storage is continuously performed, and at a timing when the DTCs are stored, the operation data is stored as the failure-time data Do. As a recording time width for such stored data Do, and as a predetermined time width before and after the trigger timing, for example, the operation data is stored with a time width of 5 seconds before and 10 seconds after.

Hereinafter, conditions (or settings) for the ECUs 32 in relation to storage of the DTCs and the failure-time data Do will be referred to as "failure-detection-time storage conditions Cso" or simply "storage conditions Cso". The failure-time data Do are driving parameter data. In the storage conditions Cso, there are included timings for storing the DTCs and the failure-time data Do, and the contents, etc., of the data Do to be stored.

The diagnostic data storage function 84 is a function for storing, as data Dd for diagnosis (hereinafter referred to as "diagnostic data Dd"), the operation data at a trigger timing, which is set separately as described later, without relation to the timing at which the DTCs are generated. The diagnostic data Dd, similar to the failure-time data Do, are driving parameter data that are stored (recorded) during driving of the vehicle 12. Hereinafter, the trigger operating conditions (or setting conditions) for the ECUs 32 in relation to storage of the diagnostic data Dd will be referred to as "arbitrary setting storage conditions Cop" or "storage conditions Cop". The storage conditions Cop include the timing (trigger timing) at which the diagnostic data Dd are stored.

Further, as a recording time width for such stored data Dd, and as a predetermined time width before and after the trigger timing, for example, the operation data is stored with a time width which is shorter than the failure-time data Do, for example, a time width of 5 seconds before and 5 seconds after.

The storage condition setting function 86 sets the arbitrary setting storage conditions Cop. The storage prohibition function 88 prohibits storage of the storage condition data Dso, as described below, when predetermined conditions are satisfied.

(A-1-2-2-3. Memories 44 of the ECUs 32)

Each of the memories 44 (see FIGS. 1 and 2) stores various programs and various data (including a database) for executing the functions 70, 72. Among such data, there are included the types Cecu of the ECUs 32*a* to 32*i* (hereinafter also referred to as "ECU types Cecu"), ECU individual identification information IDecu (hereinafter also referred to as "ECU IDs"), and storage condition data Dsc, Dso. The ECU types Cecu (first identifier) and the ECU IDs (second identifier) are associated with the kind (brand name), year, type, and grade, etc., of the vehicle 12. In the memory 44, there are separately provided an area (first area) in which the storage condition data Dsc are stored, and an area (second area) in which the ECU types Cecu are stored. Details of the ECU IDs and the storage condition data Dsc, Dso will be described later.

Further, in the memory 44, there are stored DTCs and failure-time data Do responsive to the failure-detection-time storage conditions Cso, together with diagnostic data Dd depending on the arbitrary setting storage conditions Cop.

Furthermore, vehicle equipment information Iins (hereinafter referred to as equipment information Iins) is stored in the memory 44. The equipment information Iins is information in relation to the equipment of the vehicle 12 that is associated with the diagnostic data Dd or the storage conditions Cop. In the equipment information Iins, there are included, for example, the presence or absence of an idle stop system, and the presence or absence of a turbo function.

(A-1-3. External Diagnostic Machine 14)

(A-1-3-1. Outline)

The external diagnostic machine 14 reads out various types of recorded data (a combination of DTCs and the failure-time data Do, or the diagnostic data Dd) from a specified ECU 32, analyzes such data, and performs a failure diagnosis. Further, the diagnostic machine 14 of the present embodiment sets the arbitrary setting storage conditions Cop of the ECUs 32. As shown in FIG. 1, the diagnostic machine 14 includes an input/output unit 90, a communications unit 92, an arithmetic processor 94, a memory 96, and a display unit 98. The diagnostic machine can be constituted, for example, from a commercially available notebook type personal computer or a tablet terminal.

(A-1-3-2. Input/Output Unit 90)

The input/output unit 90 is a unit for input and output of signals, and includes operation input devices such as a keyboard and a mouse.

(A-1-3-3. Communications Unit 92)

The communications unit 92 communicates with the server 16 via the Internet 200. In addition, the communications unit 92 communicates with the vehicle 12 through a data link connector 100 and a data link cable 102.

As shown in FIG. 2, the arithmetic processor 94 includes a vehicle communications function 110 for connection to the in-vehicle networks 50*a*, 50*b* of the vehicle 12, and a data analysis function 112 for the data (DTC, data Do, Dd) obtained from the vehicle 12. The respective functions 110, 112 are realized by the arithmetic processor 94 executing the programs stored in the memory 96.

The vehicle communications function 110 includes a data readout function 120 and a storage condition setting function 122. The data readout function 120 reads out data (DTCs, data Do, Dd) from the specified ECU 32. The storage condition setting function 122 sets the storage conditions Cop for the diagnostic data Dd concerning the specified ECU 32.

The data analysis function 112 is a function for analyzing the cause of a failure using the various data that were read out.

(A-1-3-4. Memory 96)

The memory 96 (see FIGS. 1 and 2) of the diagnostic machine 14 stores various programs and various data (including a database) for executing the functions 110, 112. In the database, there are included a vehicle database 130

(hereinafter referred to as a "vehicle DB 130" or simply a "DB 130"), and a diagnostic data file database 132 (hereinafter referred to as a "diagnostic data file DB 132" or simply a "DB 132"). The vehicle DB 130 contains various data in relation to the vehicle 12.

The diagnostic data file DB 132 stores therein a plurality of files Fdd (hereinafter referred to as "diagnostic data files Fdd") including various data in relation to acquisition of diagnostic data Dd. The files Fdd each contain storage condition data Dsc (arbitrary setting storage condition data Dsc), and an ECU type Cecu and an ECU ID of the target ECU 32*tar*. The target ECU 32*tar* is one of the ECUs 32 that is a target for setting of the arbitrary setting storage conditions Cop. The files Fdd can be appropriately updated. Further, the files Fdd can be acquired from the server 16 and used by the diagnostic machine 14.

(A-1-4. Server 16)

The server 16 supplies various information of the vehicle 12 to the external diagnostic machine 14 responsive to requests from the external diagnostic machine 14. The server 16 comprises an input/output unit, an arithmetic processor, a memory, and a display unit (none of which are shown). As shown in FIG. 1, the server 16 is equipped with a vehicle database 160 (hereinafter referred to as a "vehicle DB 160") in which various information in relation to the vehicle 12 is stored.

A-2. Various Types of Data and Information (A-2-1. Contents of Diagnostic Data Dd and Failure-Time Data Do)

As noted above, the diagnostic data Dd and the failure-time data Do in the present embodiment are driving parameter data, which are used in carrying out a failure diagnosis of the vehicle 12. As previously noted, the failure-detection-time storage conditions Cso are conditions for storage of the failure-time data Do accompanying storage of DTCs (i.e., accompanied by a judgement determination of the occurrence of failure). The arbitrary setting storage conditions Cop are conditions for storage of diagnostic data Dd that is not accompanied by storage of DTCs (i.e., without a judgment determination of the occurrence of a failure).

As diagnostic data Dd that is desired to be recorded, for example, the following items can be included. For example, in the case that one desires to diagnose the driven state (in relation to the engine or the traction motor) of the vehicle 12, the engine ECU is specified separately for items in relation to the engine ECU, and the motor ECU is specified separately for items in relation to the motor ECU, storage conditions Csd desired to be recorded (referred to as "storage conditions Csd" hereinafter) are set in the corresponding ECU, and the diagnostic data Dd are acquired.

In this case, as storage conditions Csd that are set in the engine ECU, there may be included, for example, a vehicle speed detected by a non-illustrated vehicle speed sensor, the temperature of the engine cooling water detected by a non-illustrated temperature sensor, the engine RPM, which is calculated by the engine ECU based on a crank angle detected by a non-illustrated crank angle sensor, an intake pressure detected by a non-illustrated intake pressure sensor, and items in relation to various setting values of the engine ECU.

As storage conditions Csd that are set in the motor ECU, there may be included, for example, the motor RPM, which is calculated by the motor ECU based on an output from a non-illustrated resolver, a remaining capacity of a high voltage battery for a drive motor, and items in relation to various setting values of the motor ECU.

(A-2-2. ECU Type Cecu and ECU ID)

As noted previously, the memories 44 of the respective ECUs 32 of the present embodiment store the ECU type Cecu (first identifier) and an ECU ID (second identifier).

The ECU types Cecu are indicative of ranges (management ranges or control ranges) or targets (management targets or control targets) managed by the respective ECUs 32. Within the ECU types Cecu, there are included multiple ECUs, such as the engine ECU, the motor ECU, and the transmission ECU, etc. The ECU types Cecu can also include identifying information for units such as an engine control unit, a motor control unit, a transmission control unit, etc. The ECU types Cecu of the present embodiment are represented by data amounts shorter than the ECU IDs, and are made up, for example, from two-character or three-character data strings.

The ECU IDs serve to identify the respective ECUs themselves, and include, for example, the kind (brand name), year, type, and grade of the vehicle 12, along with version information of programs thereof, etc. The ECU IDs also indicate, for example, whether the engine is either one of a gasoline engine or a diesel engine, and whether the transmission is either one of an automatic (AT) type (using a torque converter, for example) or a continuously variable transmission (CVT) type of transmission. Therefore, the ECU IDs can be referred to as identifying information of the systems that make up the units. The ECU IDs of the present embodiment are represented by data amounts longer than the ECU types Cecu, and are made up, for example, from any of eight-character to ten-character data strings.

(A-2-3. Storage Condition Data Dsc)

The storage condition data Dsc (arbitrary setting storage condition data Dsc) are data made up of a combination of driving parameters and judgment conditions, for defining by arbitrary set storage conditions Cop for storing the diagnostic data Dd. Such combined data are selected in accordance with driving conditions for the purpose of generating diagnostic data Dd desired to be recorded.

The storage timing is a trigger timing for actually carrying out storage of the diagnostic data Dd in the ECUs. The storage timing can be set at a point in time when specified driving parameters (e.g., engine RPM, vehicle speed, an accelerator operation amount) arrive at specified values, a point in time when such values are exceeded or are not reached, or a point in time when a predetermined time period has elapsed after initiation of a target component. Alternatively, the start timing is set to a timing at which a specific device such as the accelerator pedal, the brake pedal, the shift lever or the like has reached a specific state (for example, an ON/OFF state, a connected/disconnected state, or a shift position of R). The respective driving parameters and the trigger conditions (judgment conditions) are set by the storage condition data Dsc, in combination with a logical AND condition or a logical OR condition, or the like.

A-3. Failure Diagnosis

Next, a description will be given concerning various operations and processes carried out in relation to a failure diagnosis in the present embodiment.

(A-3-1. Overall Process Flow)

Figure 3:
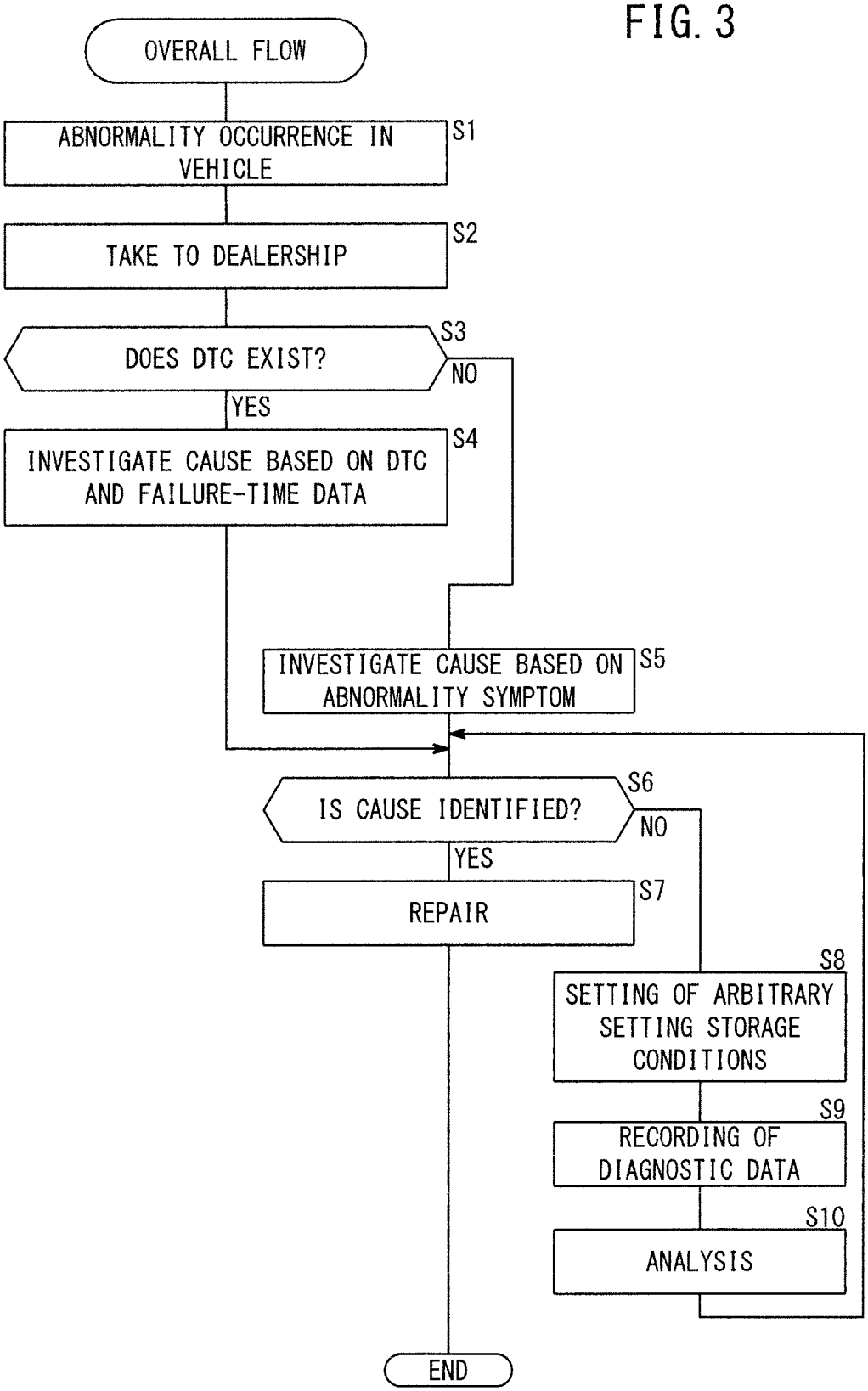
FIG. 3 is a flowchart showing an example of an overall flow of operations of a user of the vehicle and an operator of a dealership that take place during a failure diagnosis according to the present embodiment.

FIG. 3 is a flowchart showing an example of an overall flow of operations of a user of the vehicle 12 and an operator of a dealership that take place during a failure diagnosis according to the present embodiment. In step S1, a failure occurs in the vehicle 12, and the user of the vehicle 12 confirms the failure. In step S2, the user takes the vehicle 12 to the dealership.

In step S3, an operator of the dealership, using the diagnostic machine 14, confirms whether a DTC accompanying the failure has been stored in the ECUs 32. If a DTC has been stored (step S3: YES), then in step S4, the operator investigates the cause of the malfunction based on the DTC and the failure-time data Do.

If a DTC has not been stored (step S3: NO), then in step S5, the operator investigates the cause of the abnormality based on at least one of an abnormality symptom in the vehicle 12 and the content of the malfunction heard from the user. If the cause of the abnormality could be identified from step S4 or step S5 (step S6: YES), then in step S7, the operator repairs the vehicle 12 on the basis of the cause of the malfunction.

If the cause of the abnormality could not be identified (step S6: NO), then in steps S8 to S10, the operator acquires from the vehicle 12 diagnostic data Dd in a driving state considered to be related to the occurrence of the abnormality, and performs detailed analysis of such data.

More specifically, in step S8, the operator takes into consideration the abnormality symptoms of the vehicle and the details of the malfunction as heard from the user, and investigates what kind of diagnostic data Dd are necessary to perform a diagnosis. In addition, using the diagnostic machine 14, the operator sets arbitrary setting storage conditions Csd, which are believed to be necessary for obtaining diagnostic data Dd indicative of non-detection of a failure.

In step S9, by driving the vehicle 12 with such a set state, the operator drives the vehicle 12 in a state to reproduce or come close to the abnormality symptom, or in a state to approximate conditions for generating the malfunction as heard from the user. At this time, when the storage conditions Cop are satisfied, the target ECU 32*tar* records the diagnostic data Dd, which are data of the driving state at the specified trigger timing. Then, using the diagnostic machine 14, the operator reads out the diagnostic data Dd from the target ECU 32*tar*.

In step S10, the operator analyzes the diagnostic data Dd recorded by the target ECU 32*tar*. After step S10, the routine returns to step S6. In addition, as a result of analyzing the diagnostic data Dd recorded with the storage conditions Csd, it is judged whether or not a cause of the abnormality could be identified.

(A-3-2. Process Flow of Diagnostic Machine 14 Upon Setting of Arbitrary Setting Storage Conditions Cop)

(A-3-2-1. Advance Preparations)

When setting the arbitrary setting storage conditions Cop of the ECUs 32, the operator initially updates respective storage condition setting programs Psc which are stored in the memory 96 of the diagnostic machine 14. More specifically, the operator operates the diagnostic machine 14 to download the most recent versions of the storage condition setting programs Psc from the server 16. The storage condition setting programs Psc include storage condition data Dsc corresponding to the kind (brand name), year, type and grade, etc., of the vehicle 12.

Updating thereof preferably is carried out periodically on designated dates. However, even if such updating is slightly delayed, there is no major problem. Further, instead of the server 16, it also is possible to perform updating by way of an electronic medium.

(A-3-2-2. Setting of Arbitrary Setting Storage Conditions Cop)

Figure 4:
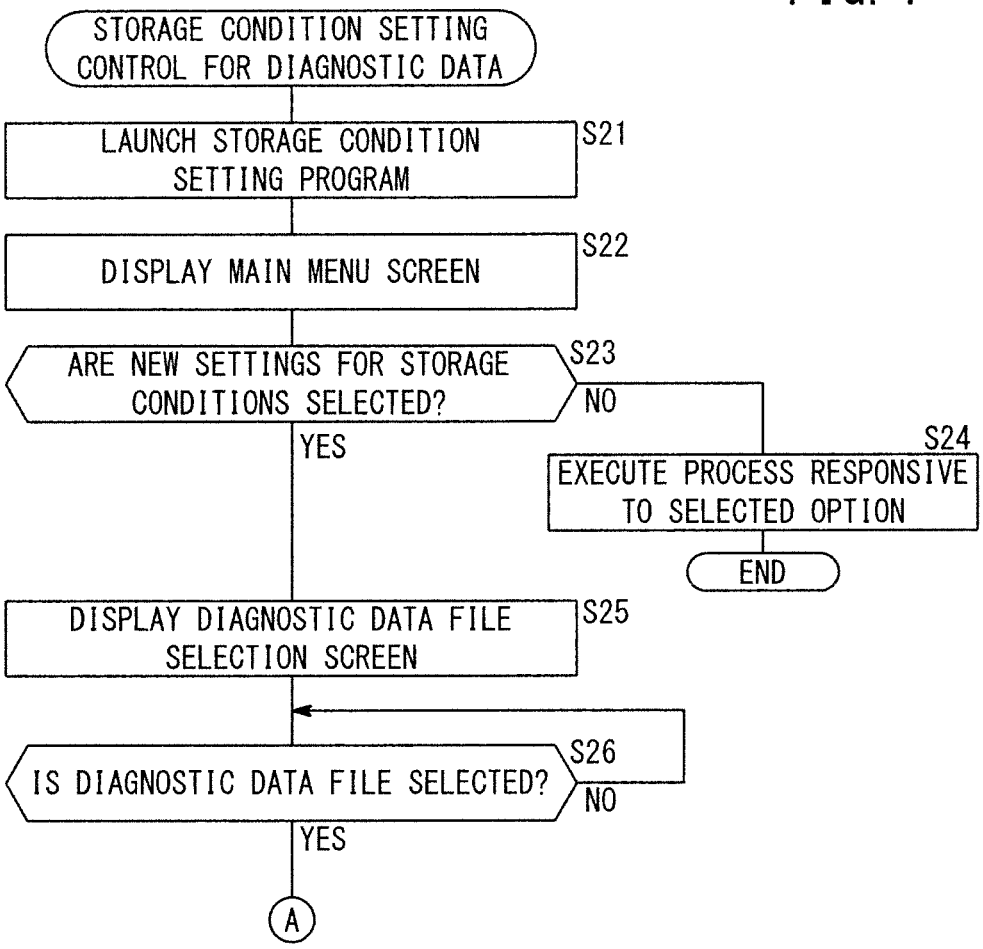
FIG. 4 is a first flowchart showing an example of processes at a time of setting arbitrary setting storage conditions according to the present embodiment, with the external diagnostic machine serving as a main body in which such processes are performed.
Figure 5:
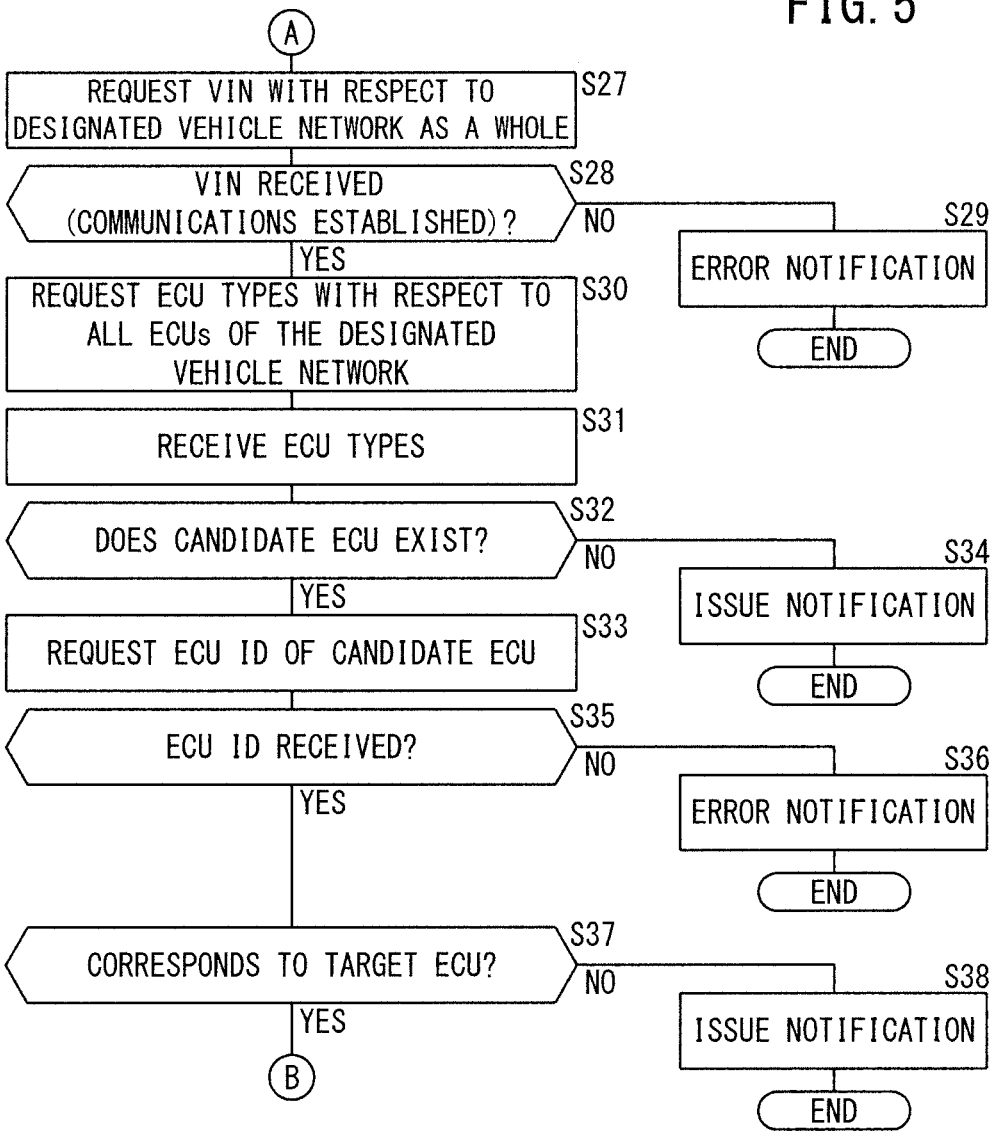
FIG. 5 is a second flowchart showing an example of processes at a time of setting the arbitrary setting storage conditions according to the present embodiment, with the external diagnostic machine serving as a main body in which such processes are performed.
Figure 6:
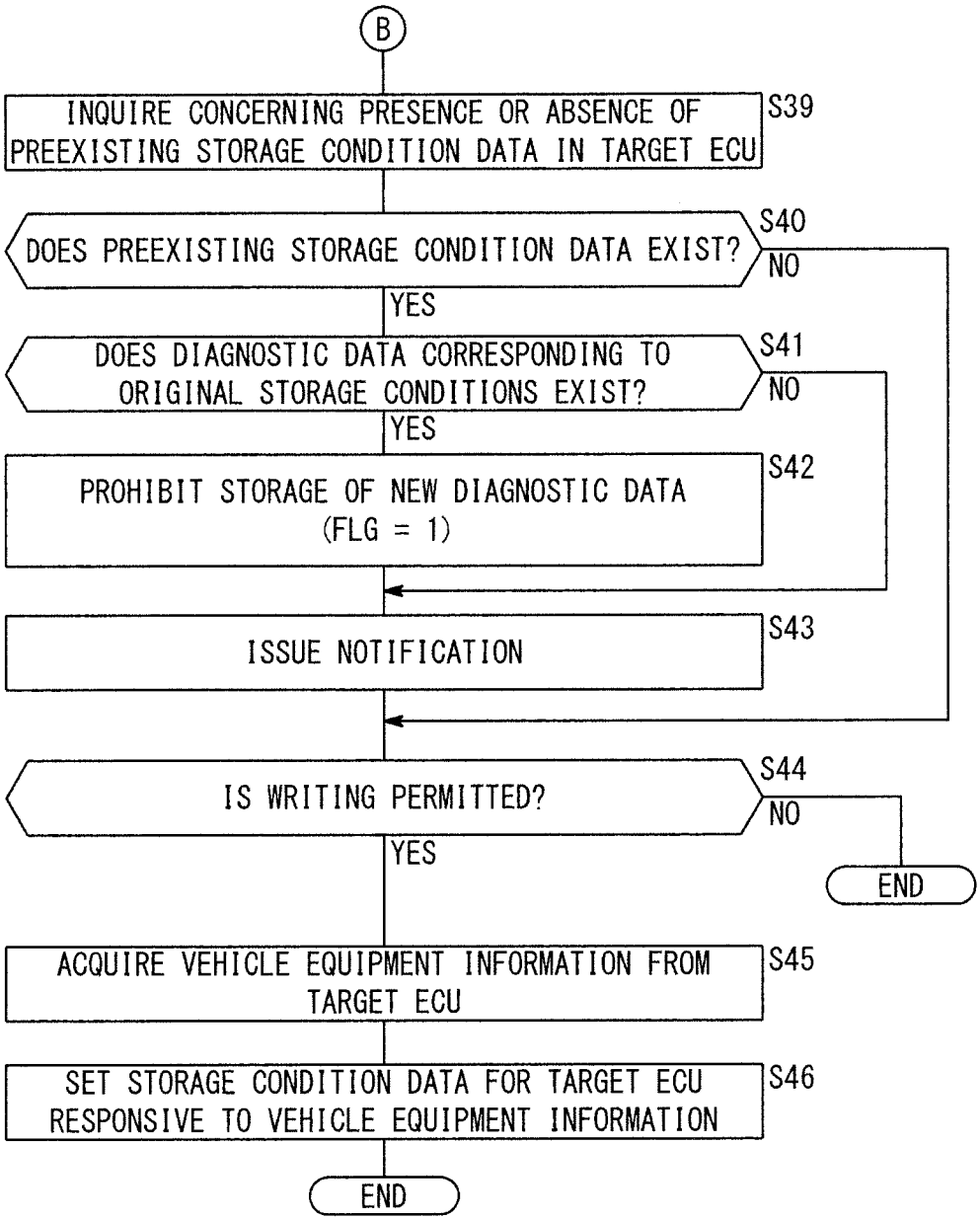
FIG. 6 is a third flowchart showing an example of processes at a time of setting the arbitrary setting storage conditions according to the present embodiment, with the external diagnostic machine serving as a main body in which such processes are performed.

FIGS. 4 through 6 are first through third flowcharts showing an example of processes at a time of setting the arbitrary setting storage conditions Cop according to the present embodiment, with the external diagnostic machine 14 serving as a main body in which such processes are performed. In step S21 of FIG. 4, the diagnostic machine 14 launches the storage condition setting programs Psc in response to an operation from the operator. Ordinarily, prior to step S21, the operator connects the data link connector 100 of the diagnostic machine 14 (see FIG. 1) to the data link connector 30 of the vehicle 12.

In step S22, the diagnostic machine 14 displays a main menu screen Sm (not shown) including a main menu Mm. On the main menu screen Sm, it is possible to select new settings for the storage conditions Cop, erasure of the storage conditions Cop, and readout of the diagnostic data Dd. Stated otherwise, on the main menu screen Sm, options are displayed for newly setting the storage conditions Cop, erasure of the storage conditions Cop, and readout of the diagnostic data Dd.

According to the present embodiment, when the storage conditions Cop are set, in the case that storage conditions Csd for acquisition of previous diagnostic data Dd are already set and such conditions are to be modified, the original storage conditions Cop are erased, and thereafter, the new storage conditions Cop are set.

Returning to step S23, if the option selected by the main menu Mm is to newly set the storage conditions Cop (step S23: YES), the routine proceeds to step S25.

In step S25, the diagnostic machine 14 displays a selection screen Ss for the diagnostic data file Fdd. The diagnostic data file Fdd depends on the contents (stated otherwise, the diagnostic items) of the diagnostic data Dd to be acquired. On the selection screen Ss, there can be displayed as options the contents of malfunction symptoms corresponding to the diagnostic data file Fdd (e.g., an acceleration failure, an idle stop failure, etc.).

In addition, as storage conditions Cop that correspond to each of contents of the respective malfunction symptoms, from among the respective options set by combining in plurality the storage condition data Dsc to determine a trigger condition, the one thought to be most appropriate is selected and set. When selection of any file Fdd is made on the selection screen Ss (step S26: YES), the routine proceeds to step S27.

In step S27 of FIG. 5, responsive to an operation of the operator, the diagnostic machine 14 transmits with respect to the in-vehicle networks 50*a*, 50*b* as a whole a VIN request signal Svin (vehicle identifying information request signal) for requesting the VIN. The VIN is a vehicle body serial number, which functions as vehicle identifying information. It is required that the VIN be stored in only one ECU 32 in relation to one vehicle 12. In the present embodiment, the VIN is stored in the memory of the first ECU 32*a*. Therefore, the first ECU 32*a*, which has received the VIN request signal Svin, outputs the VIN in response to the VIN request signal Svin.

In step S28, the diagnostic machine 14 determines whether or not the VIN has been received. If the VIN is not received (step S28: NO), then in step S29, the diagnostic machine 14 issues an error notification through the display unit 98. If the VIN is received (step S28: YES), it is understood that at least communication with the in-vehicle network 50*a* has been established. Stated otherwise, it is confirmed that the in-vehicle network 50*a* has been powered on and is in an ON state.

Next, in step S30, the diagnostic machine 14 transmits an ECU type request signal Sce for requesting the ECU type Cecu with respect to each of the ECUs 32*a* to 32*i* of the in-vehicle networks 50*a*, 50*b*. Within the ECU types Cecu, there are included multiple ECUs, such as the engine ECU, the motor ECU, and the transmission ECU, etc. With respect to the ECU request signal Sce, each of the respective ECUs 32*a* to 32*i* outputs the ECU type Cecu thereof, respectively.

In step S31, the diagnostic machine 14 receives the ECU types Cecu from each of the ECUs 32*a* to 32*i*. At this time, a reception time limit is set, and the ECU types Cecu are received only within the reception time limit. In addition, among the ECUs 32*a* to 32*i* corresponding to the received ECU types Cecu, the diagnostic machine 14 judges whether or not a candidate electronic control device 32can (hereinafter referred to as a "candidate ECU 32can") exists as a candidate for the target ECU 32tar.

More specifically, the diagnostic machine 14 specifies the ECU type Cecu of the target ECU 32tar in the diagnostic data file Fdd that was selected in step S26. In addition, the diagnostic machine 14 compares the ECU type Cecu in the file Fdd with the ECU types Cecu received from the respective ECUs 32*a* to 32*i*, and sets as the candidate ECU 32can the ECU 32 having a matching ECU type Cecu.

For example, in the case it is selected to acquire an engine-related driving parameter group as the file Fdd, the engine ECU is selected as the candidate ECU 32can. Further, in the case it is selected to acquire a transmission-related driving parameter group as the file Fdd, the transmission ECU is selected as the candidate ECU 32can.

If there is a candidate ECU 32can (step S32: YES), then in step S33, the diagnostic machine 14 outputs with respect to the candidate ECU 32can an ECU ID request signal Sei for requesting the ECU ID. The candidate ECU 32can that has received the ECU ID request signal Sei outputs its own ECU ID to the diagnostic machine 14.

If there is not a candidate ECU 32can (step S32: NO), then in step S34, the diagnostic machine 14 notifies the operator of the fact that a candidate ECU 32can does not exist. Such a notification can be made, for example, by a display on the display unit 98.

After completion of step S33, in step S35, the diagnostic machine 14 determines whether or not the ECU ID has been received from the candidate ECU 32can. If the ECU ID is not received from the candidate ECU 32can (step S35: NO), then in step S36, the diagnostic machine 14 issues an error notification indicating that an ECU ID did not arrive from the candidate ECU 32can. Such a notification can be made, for example, by displaying an error message on the display unit 98.

If the ECU ID is received from the candidate ECU 32can (step S35: YES), then in step S37, the diagnostic machine 14 determines based on the received ECU ID whether or not the candidate ECU 32can corresponds to the target ECU 32tar.

In the forgoing manner, the ECU IDs serve to identify the respective ECUs 32 themselves, and include, for example, the kind (brand name), year, type, and grade of the vehicle 12, along with version information of programs thereof, etc. The ECU IDs also indicate, for example, whether the engine is either one of a gasoline engine or a diesel engine, and whether the transmission is either one of an automatic (AT) type (using a torque converter, for example) or a continuously variable transmission (CVT) type of transmission. Therefore, the diagnostic machine 14 can determine on the basis of the ECU ID whether a system corresponding to the storage condition data Dsc to be set is installed in the vehicle 12.

For example, in the case that the version indicated by the ECU ID of the candidate ECU 32can is an old version, and it is obvious that the vehicle 12 is not equipped with a portion (driving parameters) of the system, or alternatively, in the case that the candidate ECU 32can is a version that does not have an area for writing of the storage condition data Dsc, the diagnostic machine 14 determines that the candidate ECU 32can does not correspond to the target ECU 32tar.

If the candidate ECU 32can corresponds to the target ECU 32tar (step S37: YES), the routine proceeds to step S39. If the candidate ECU 32can is not the target ECU 32tar (step S37: NO), then in step S38, the diagnostic machine 14 notifies the operator of the fact that the target ECU 32tar does not exist. Such a notification is carried out, for example, by a display on the display unit 98.

In step S39 of FIG. 6, the diagnostic machine 14 makes a request with respect to the target ECU 32tar as to whether or not the arbitrary setting storage condition data Dsc already are written into the area into which the writing of the storage condition data Dsc is carried out. In step S40, based on the response from the target ECU 32tar, the diagnostic machine 14 determines whether or not the storage condition data Dsc already exists in the target ECU 32tar.

If the storage condition data Dsc already exists in the target ECU 32tar (step S40: YES), then next, in step S41, the diagnostic machine 14 determines whether or not diagnosis data Dd corresponding to the storage conditions Cop before rewriting (or the original storage conditions) are stored in the target ECU 32tar.

If diagnostic data Dd corresponding to the original storage conditions Cop are stored in the target ECU 32tar (step S41: YES), then in step S42, the diagnostic machine 14 prohibits storage of new diagnostic data Dd in the target ECU 32tar. For example, the diagnostic machine sets a storage prohibition flag FLG for the diagnostic data Dd in the target ECU 32tar. More specifically, the diagnostic machine 14 changes the storage prohibition flag FLG in the memory 44 of the target ECU 32tar from "0" to "1". Consequently, erasure of the diagnostic data Dd corresponding to the original storage conditions Cop due to storage of new diagnostic data Dd can be prevented.

When the diagnostic data Dd corresponding to the original storage conditions Cop have been read out from the diagnostic machine 14, the diagnostic machine 14 permits storage of new diagnostic data Dd. More specifically, the diagnostic machine 14 changes the storage prohibition flag FLG in the memory 44 of the target ECU 32tar from "1" to "0". Changing of the flag FLG may also be performed by the target ECU 32tar instead of the diagnostic machine 14.

If diagnostic data Dd corresponding to the original storage conditions Cop are not stored in the target ECU 32tar (step S41: NO), or after completion of step S42, the routine proceeds to step S43.

In step S43, the diagnostic machine 14 issues a notification to the operator to prompt deletion of the storage condition data Dsc from the target ECU 32tar. Such a notification is carried out, for example, by a display on the display unit 98. If the storage condition data Dsc already is present in the target ECU 32tar, and diagnostic data Dd corresponding thereto exists, the diagnostic machine 14 may also issue a notification to prompt reading out of the diagnostic data Dd. If the storage condition data Dsc is not already present in the target ECU 32tar (step S40: NO), or after completion of step S43, the routine proceeds to step S44.

In step S44, the diagnostic machine 14 determines whether or not the operator has permitted writing of the storage condition data Dsc. For example, the diagnostic machine 14 determines whether the operator has selected a write button or an abort button. If the operator has permitted writing (step S44: YES), the routine proceeds to step S45. If the operator has not permitted writing (step S44: NO), then the current process is brought to an end.

As noted above, prior to determining whether writing has been permitted in step S44, in step S43, a notification is display to prompt erasure of the storage condition data Dsc from the target ECU 32tar. In response thereto, it is necessary for the operator to read out the diagnostic data Dd that was recorded with the previously set storage condition data Dsc, or to determine that it is unnecessary to save the data. In addition, if it is necessary for the data to be stored, the operator selects non-permission, and performs an operation to save the data. If storage of such data is unnecessary, the operator selects permission, whereby the previously set data is erased as noted above.

In step S45, the diagnostic machine 14 makes a request with respect to the target ECU 32tar for the vehicle equipment information Iins, which serves as confirmation information concerning the presence or absence of driving parameters corresponding to each of the storage condition data Dsc intended to be set. In addition, in accordance with the response from the target ECU 32tar, the diagnostic machine 14 acquires the equipment information Iins. As noted above, the equipment information Iins is information in relation to the equipment of the vehicle 12 that is associated with the diagnostic data Dd or the arbitrary setting storage conditions Cop.

In step S46, among the plurality of storage condition data Dsc intended to be set, the diagnostic machine 14 selects only the storage condition data Dsc that correspond to the equipment information Iins acquired as driving parameters with which the vehicle is actually equipped. In addition, the diagnostic machine 14 sets the arbitrary setting storage conditions Cop by reading the selected storage condition data Dsc into the target ECU 32tar. More specifically, although storage condition data Dsc concerning equipment that is installed in the vehicle 12 are set, storage condition data Dsc concerning equipment that is not installed in the vehicle 12 are not set.

As discussed above, in the arbitrary setting storage conditions Cop, there is included the storage timing for the diagnostic data Dd or the content of the diagnostic data Dd to be acquired. More specifically, as settings for the storage condition data Dsc, the diagnostic machine 14 may set all of the storage condition setting programs Psc. Alternatively, among the storage condition setting programs Psc, the diagnostic machine 14 can set only a portion of the setting condition data Dsc (for example, a portion stored as variables or in the form of a map).

Returning to FIG. 4, if the option selected using the main menu Mm is not a new setting of the storage conditions Cop (step S23: NO), or stated otherwise, if the option selected using the main menu Mm is to erase the storage conditions Cop or to read out the stored diagnostic data Dd, the routine proceeds to step S24.

In step S24, the diagnostic machine 14 carries out the process in response to the option that was selected using the main menu Mm. More specifically, in the case that erasure of the storage conditions Cop was selected, the diagnostic machine 14 displays the current storage conditions Cop on the display unit 98, and responsive to an operation of the operator, erases or deletes the current storage conditions Cop. In the case that reading out of the diagnostic data Dd was selected, and responsive to an operation of the operator, the diagnostic machine 14 reads out the stored diagnostic data Dd from the ECU 32.

(A-3-3. Data Storage Prohibition Control after Setting of Arbitrary Setting Storage Conditions Cop)

As described above, with the present embodiment, in the case that the storage conditions Cop are newly set in a state in which the diagnostic data Dd is stored as is without being read out from the target ECU 32tar, storage of new diagnostic data Dd is prohibited until the concerned diagnostic data Dd is read out. Owing to this feature, it is possible for the diagnostic data Dd to be reliably read out.

Figure 7:
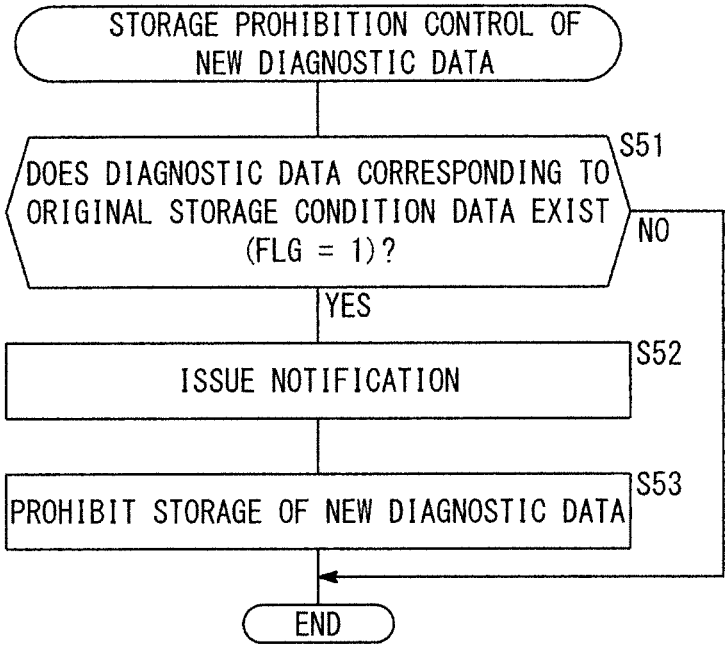
FIG. 7 is a flowchart of a data storage prohibition control performed after setting of the arbitrary setting storage conditions in the present embodiment.

FIG. 7 is a flowchart of a data storage prohibition control performed after setting of the arbitrary setting storage conditions Cops in the present embodiment. The data storage prohibition control is performed by the target ECU 32tar in which the storage condition data Dsc are newly set. In step S51, the target ECU 32tar determines whether or not there is stored therein diagnostic data Dd corresponding to the original storage condition data Dsc (before rewriting). Such a determination, for example, is performed by confirming whether or not the storage prohibition flag FLG is set to 1 in the memory 44 of the target ECU 32tar.

In the case that diagnostic data Dd corresponding to the original storage condition data Dsc is stored therein (step S51: YES), then in step S52, the target ECU 32tar notifies this fact to the operator through the non-illustrated display unit, etc., of the vehicle 12. Then, in step S53, the target ECU 32tar prohibits storage of the new diagnostic data Dd.

A-4. Effects and Advantages of the Present Embodiment

As described above, according to the present embodiment, specification of the target ECU 32tar that sets the arbitrary storage conditions Cop, and setting of only the storage conditions Cop that correspond to the equipment information Iins of the vehicle 12 can be carried out suitably corresponding to the diagnostic data file Fdd (diagnostic items) input to the input/output unit 90 (input unit) from the exterior of the vehicle 12.

Further, according to the present embodiment, the equipment information Iins of the vehicle 12 in relation to the storage conditions Cop corresponding to the diagnostic data file Fdd (diagnostic items) input to the input/output unit 90 (input unit) is obtained from the target ECU 32tar (step S45 of FIG. 6). In addition, the storage condition data Dsc are set corresponding to the equipment information Iins of the target ECU 32tar (step S46). Consequently, the storage conditions Cop are not set mistakenly in relation to driving parameters that cannot be acquired by the vehicle 12 that serves as the diagnostic target, and it is possible to eliminate mistaken operations (trigger malfunctions) for which data storage cannot be performed.

In the present embodiment, when searching for the target ECU 32tar, the diagnostic machine 14 (storage condition setting device) transmits with respect to the in-vehicle networks 50*a*, 50*b* as a whole a common an ECU type request signal Sce (ECU identifying information request signal) Sce for requesting the ECU type Cecu (step S30 of FIG. 5). In accordance with this feature, the diagnostic machine 14 is capable of specifying the target ECU 32tar by collectively acquiring the ECU types Cecu of the plurality of ECUs 32*a* to 32*i*.

In the present embodiment, after being connected to the in-vehicle networks 50*a*, 50*b*, the diagnostic machine 14 first transmits with respect to the in-vehicle networks 50*a*, 50*b* as a whole a VIN request signal Svin (vehicle identifying information request signal) for requesting the VIN (vehicle identifying information) (step S27 of FIG. 5). Further, the diagnostic machine 14 acquires the VIN by receiving a corresponding signal to the VIN request signal Svin from the ECU 32*a* in which the VIN is stored, together with initiating a search for the target ECU 32tar (step S28, etc.).

In accordance with this feature, confirmation of the ON state (i.e., a state in which communications are possible) of the in-vehicle network 50*a* can be carried out concurrently with acquisition of the VIN. Consequently, processing can be simplified compared to the case of acquiring the VIN after having confirmed the ON state.

In the present embodiment, when the storage condition data Dsc are set in the target ECU 32tar, and in the case that preexisting storage condition data Dsc exist in the target ECU 32tar (step S40 of FIG. 6: YES), the diagnostic machine 14 issues a notification to prompt erasure of the storage condition data Ds from the target ECU 32tar (step S43). In accordance with this feature, even in the case that recording of operation data is repeatedly performed responsive to storage conditions Cop that differ, diagnostic data Dd corresponding to the preexisting storage condition data Dsc can be read out from the target ECU 32tar without forgetting.

In the present embodiment, the memories 44 of the plurality of target ECUs 32*a* to 32*i* each separately comprises an area (first area) in which the storage condition data Dsc of the diagnostic data Dd are stored, and an area (second area) in which there are stored failure-time storage condition data Dso, which define failure-time storage conditions Cso for storing, together with a failure code, failure-time data Do when a failure occurs. In accordance with this feature, storage of failure-time data Do and failure codes, as well as storage of diagnostic data Dd can both be managed.

In the present embodiment, the plurality of ECUs 32*a* to 32*i* that reside within the in-vehicle networks 50*a*, 50*b* each include an ECU type Cecu (first identifier) for narrowing the candidates (candidate ECU 32can) for the target ECU 32tar from among the plurality of ECUs 32*a* to 32*i*, and an ECU ID (second identifier) for determining whether or not the candidate ECU 32can is the target ECU 32tar (see FIG. 2). The diagnostic machine 14 requests the ECU type Cecu with respect to the plurality of ECUs 32*a* to 32*i* (step S30 of FIG. 5), and narrows the candidates for the candidate ECU 32can using the ECU types Cecu received from the plurality of ECUs 32*a* to 32*i* (step S32). Further, the diagnostic machine 14 requests the ECU ID with respect to the candidate ECU 32can (step S33), and determines whether or not the candidate ECU 32can is the target ECU 32tar using the ECU ID received from the candidate ECU 32can (step S37).

In accordance with this feature, by making judgments in accordance with the ECU types Cecu and the ECU IDs, a more detailed distinction can be made.

In the present embodiment, the storage conditions Cop for the diagnostic data Dd include a storage timing for storing the diagnostic data Dd. In accordance with this feature, arbitrary diagnostic data Dd that an operator wishes to acquire can be acquired in various situations.

B. Modifications

The present invention is not limited to be embodiment described above. It is a matter of course that various additional or modified arrangements can be adopted based on the disclosed content of the present specification. For example, the following configurations can be adopted.

B-1. Objects to which the Invention is Applied

Although according to the present embodiment, the external diagnostic machine 14 is used for a vehicle 12, the present invention is not limited to this feature. For example, a stand-alone type of device (for example, a moving object such as a ship, aircraft, or various manufacturing devices) equipped with a local network to which the plural ECUs 32 are connected can be used.

[B-2. Vehicle 12]

Although according to the present embodiment, a CAN is used as the in-vehicle networks 50*a*, 50*b*, the invention is not limited to this feature, and other network types, such as LIN, FlexRay, K-line, etc., may be used.

According to the present embodiment, the IGSW 60 has been described on the premise of being a rotary switch. However, the IGSW 60 may be a switch, such as a push type switch or the like, which is provided in the vehicle 12 as a diagnostic target for actual data collection. Further, although in the narrow sense, the IGSW 60 implies an ignition switch used in a vehicle 12 having an engine, in this instance, the IGSW 60 implies a starting switch for the vehicle 12 and can be used with the same method, even if the vehicle 12 is an EV (electric vehicle).

[B-3. External Diagnostic Machine 14]

(B-3-1. Configuration)

According to the above-described embodiment, the external diagnostic machine 14 is constituted, for example, from a commercially available notebook type personal computer or a tablet terminal. For example, the diagnostic machine 14 may be constituted from a personal computer as a main body portion thereof, and a slave unit (repeater) serving as an interface with the diagnostic machine 14.

According to the above-described embodiment, the diagnostic software that is used by the diagnostic machine 14 is recorded beforehand in the memory 96. However, the invention is not limited to this feature. For example, the diagnostic software may be downloaded from an external source (e.g., an external server capable of communications via a public network), or may be executed as a program by a so-called ASP (Application Service Provider) without being downloaded.

According to the above-described embodiment, although communications between the vehicle 12 and the diagnostic machine 14 are carried out by way of wired communications (see FIG. 1), wireless communications may also be used.

(B-3-2. Extraction of Target ECU 32tar)

In the above-described embodiment, the diagnostic machine 14 treats the two in-vehicle networks 50*a*, 50*b* as the range over which the ECU type request signal Sce is transmitted for extracting the candidate ECU 32can or the target ECU 32tar (step S30 of FIG. 5). However, for example, insofar as a range is identified in order to acquire ECU IDs for extracting the target ECU 32tar, the invention is not limited to this feature. For example, if the possibility for existence of the target ECU 32tar lies within only one of the in-vehicle networks 50*a*, 50*b*, the ECU type request signal Sce may be transmitted only over that one network.

According to the above-described embodiment, after having extracted the candidate ECU 32can (steps S30 to S32 of FIG. 5), the target ECU 32tar is extracted (steps S33, S35, S37). Such a feature, for example, is also indicated by carrying out in a sequence of two stages made up of a step of extracting the presence or absence of an engine control ECU (engine ECU) as a candidate ECU 32can, and a step of determining as the target ECU 32tar whether the candidate ECU 32can is a gasoline engine control unit or a diesel engine control unit.

However, from the standpoint of extracting the target ECU 32tar, the invention is not limited to this feature. For example, if a network configuration is provided in which the target ECU 32tar can be extracted in a one-stage step (or with only one discrimination means), the target ECU 32tar can be extracted without first performing extraction of the candidate ECU 32can.

According to the above-described embodiment, when the candidate ECU 32can is extracted, the ECU type request signal Sce is transmitted with respect to the networks 50*a*, 50*b* as a whole (step S30 of FIG. 5). Stated otherwise, the ECU type request signal Sce is a common signal with respect to each of the ECUs 32*a* to 32*i*. However, for example, from the standpoint of extracting the target ECU 32tar, the invention is not limited to this feature. For example, multiple kinds of ECU type request signals Sce may be provided beforehand, and by transmitting them in order with respect to the networks 50*a*, 50*b*, the ECU types Cecu of each of the ECUs 32*a* to 32*i* may be acquired. This is also similar to the case of extracting the target ECU 32tar without carrying out extraction of the candidate ECU 32can.

(B-3-3. Setting Target)

According to the present embodiment, as a target to which the diagnostic machine 14 sets content, the arbitrary setting storage conditions Cop have been offered as an example thereof (see FIGS. 4 through 6). However, for example, from the standpoint of the diagnostic machine (storage condition setting device) setting or modifying the conditions for storage of any of the data in the ECUs 32, the invention is not limited to this feature. For example, in addition to setting the arbitrary setting storage conditions Cop, the diagnostic machine 14 may set storage conditions for the DTCs or the failure-detection-time storage conditions Cso.

(B-3-4. Preservation of Data Stored by ECUs 32)

According to the above-described embodiment, after new settings (modifications) of the storage conditions Cop are completed, in the case that diagnostic data Dd exists corresponding to the storage conditions Cop prior to modification thereof (step S41 of FIG. 6: YES), a flag FLG to prohibit storage of new diagnostic data Dd is set (step S42). However, for example, from the standpoint of protecting the diagnostic data Dd corresponding to the storage conditions Cop prior to modification thereof, the invention is not limited to this feature. For example, the flag FLG may be set prior to performing modification of the storage conditions Cop.

According to the above-described embodiment, in the case that diagnostic data Dd exists corresponding to the storage conditions Cop prior to modification thereof (step S41 of FIG. 6: YES), storage of new diagnostic data Dd is prohibited (step S42). However, for example, from the standpoint of protecting the diagnostic data Dd corresponding to the storage conditions Cop prior to modification thereof, the invention is not limited to this feature. For example, instead of prohibiting storage of the diagnostic data Dd, as long as the diagnostic data Dd is not read out, modification of the storage conditions Cop may be prohibited.

According to the above-described embodiment, in the case that diagnostic data Dd exists corresponding to the storage conditions Cop prior to modification thereof (step S41 of FIG. 6: YES), the diagnostic machine 14 sets the storage prohibition flag FLG in the target ECU 32tar (step S42). However, the main body in which protection of the diagnostic data Dd is determined may be the target ECU 32tar or another of the ECUs 32.

According to the above-described embodiment, in the case that diagnostic data Dd exists corresponding to the storage conditions Cop prior to modification thereof (step S41 of FIG. 6: YES), storage of new diagnostic data Dd is prohibited (step S42). Stated otherwise, regardless of whether or not the diagnostic data Dd has been read once, storage of new diagnostic data Dd is prohibited until the concerned diagnostic data Dd has been erased. However, for example, from the standpoint of protecting the diagnostic data Dd corresponding to the storage conditions Cop prior to modification thereof, the invention is not limited to this feature. For example, a readout history flag indicative of whether or not the diagnostic data Dd has been read out may be set, and in the case that the state indicated by the flag shows that such data has never been read out, modification of the storage conditions Cop may be prohibited, whereas if such data has been read out at least once, modification of the storage conditions Cop may be permitted.

C. Description of Reference Characters

10 . . . diagnostic system (data storage system)
12 . . . vehicle
14 . . . external diagnostic machine (storage condition setting device)
32, 32*a* to 32*i* . . . ECU
32tar . . . target ECU
50*a*, 50*b* . . . in-vehicle network
96 . . . memory of external diagnostic machine
Cecu . . . ECU type (identifying information, first identifier)
Cop . . . arbitrary setting storage conditions (storage conditions)
Cso . . . failure-time storage conditions
Dd . . . diagnostic data
Dsc . . . arbitrary setting storage condition data (storage condition data)
Dso . . . failure-time storage condition data
Fdd . . . diagnostic data file (diagnostic items)
IDecu . . . ECU individual identifying information (identifying information, second identifier)
Iins . . . vehicle equipment information
Sce . . . ECU type request signal (ECU identifying information request signal)
Svin . . . VIN request signal (vehicle identifying information request signal)

What is claimed is:

1. A storage condition setting device for setting storage conditions for diagnostic data, and which is connected from an exterior of a vehicle with respect to a specified electronic control device, hereinafter referred to as a target ECU, which monitors driving conditions of the vehicle and stores operation data as diagnostic data in case of failure;

wherein the storage condition setting device is separate and distinct from devices or units installed in the vehicle, wherein the storage condition setting device comprises:

an input unit for inputting a diagnostic item; and a memory for storing in association with the diagnostic item the storage conditions and identifying information of the target ECU; and wherein the storage condition setting device comprises one or more processors having functions to:

search, from among a plurality of electronic control devices, hereinafter referred to as ECUs, that exist within an in-vehicle network of the vehicle, for the target ECU that corresponds to the diagnostic item input to the input unit;

acquire, from the target ECU, equipment information of the vehicle related to the storage conditions that correspond to the diagnostic item; and select and set as storage condition data in the target ECU only those storage conditions that correspond to the equipment information from among the storage conditions.

2. The storage condition setting device according to claim 1, wherein, when searching for the target ECU, the storage condition setting device transmits with respect to the in-vehicle network as a whole a common identifying information request signal for requesting identifying information of the plurality of ECUs.

3. The storage condition setting device according to claim 1, wherein the storage condition setting device:

after being connected to the in-vehicle network, first transmits with respect to the in-vehicle network as a whole a vehicle identifying information request signal for requesting vehicle identifying information; and acquires the vehicle identifying information by receiving a corresponding signal from an electronic control unit in which the vehicle identifying information is stored, together with initiating a search for the target ECU.

4. The storage condition setting device according to claim 1, wherein, when the storage condition data is to set in the target ECU, and in a case that storage condition data has already existed in the target ECU, the storage condition setting device issues a notification to prompt erasure of the existed storage condition data from the target ECU.

5. The storage condition setting device according to claim 1, wherein the memory of the target ECU separately comprises:

a first area in which the storage conditions are stored; and a second area in which there are stored failure-time storage condition data, which define failure-time storage conditions for storing, together with a failure code, failure-time data when a failure occurs.

6. The storage condition setting device according to claim 1, wherein:

the plurality of ECUs that reside within the in-vehicle network each includes:

a first identifier for narrowing candidates for the target ECU from among the plurality of ECUs; and a second identifier for determining whether or not the candidates for the target ECU are the target ECU; and the storage condition setting device:

requests the first identifier with respect to the plurality of ECUs;

narrows the candidates for the target ECU using the first identifiers received from the plurality of ECUs;

requests the second identifier with respect to the candidates for the target ECU; and determines whether or not the candidates for the target ECU are the target ECU using the second identifiers received from the candidates for the target ECU.

7. The storage condition setting device according to claim 1, wherein the storage conditions include a storage timing for storing the diagnostic data.

8. A data storage system equipped with a storage condition setting device for setting storage conditions for diagnostic data, and which is connected from an exterior of a vehicle with respect to an in-vehicle network, and a specified electronic control device, hereinafter referred to as a target ECU, which monitors driving conditions of the vehicle and stores operation data as diagnostic data in case of failure;

wherein the storage condition setting device is separate and distinct from devices or units installed in the vehicle, wherein the storage condition setting device comprises:

an input unit for inputting a diagnostic item; and a memory for storing in association with the diagnostic item the storage conditions and identifying information of the target ECU; and wherein the storage condition setting device comprises one or more processors having functions to:

search, from among a plurality of electronic control devices that exist within the in-vehicle network, for the target ECU that corresponds to the diagnostic item input to the input unit;

acquire, from the target ECU, equipment information of the vehicle related to the storage conditions that correspond to the diagnostic item; and select and set as storage condition data in the target ECU only those storage conditions that correspond to the equipment information from among the storage conditions.

* * * * *